United States Patent [19]

Isaacson

[11] 3,990,808

[45] Nov. 9, 1976

[54] INFLATABLE BLOWER

[76] Inventor: Boris Isaacson, 14532 Vanowen St., Van Nuys, Calif. 91405

[22] Filed: Nov. 24, 1975

[21] Appl. No.: 634,620

[52] U.S. Cl. ..... 415/141; 415/200; 415/214; 416/143; 416/240; 416/132 A

[51] Int. Cl.[2] ..... F04D 29/18

[58] Field of Search ..... 415/141, 197, 200, 214; 416/143, 227, 227 A, 240, 132, 84

[56] References Cited

UNITED STATES PATENTS

| | | | |
|---|---|---|---|
| 535,602 | 3/1895 | Sherman | 416/132 |
| 1,001,291 | 8/1911 | Mc Kenzie | 416/240 |
| 1,046,372 | 12/1912 | Bassett | 416/240 |
| 1,868,113 | 7/1932 | Ljungstrom | 416/143 |
| 1,961,228 | 6/1934 | Knox | 416/240 |
| 2,115,134 | 4/1938 | Andersen | 415/200 |
| 2,677,344 | 5/1954 | Annis | 416/143 |
| 2,973,716 | 3/1961 | Thomas | 415/200 |
| 3,115,099 | 12/1963 | Clay | 415/200 |

FOREIGN PATENTS OR APPLICATIONS

| | | | |
|---|---|---|---|
| 598,017 | 6/1934 | Germany | 416/227 A |
| 368,204 | 3/1932 | United Kingdom | 416/227 A |
| 564,918 | 10/1944 | United Kingdom | 416/240 |

*Primary Examiner*—Henry F. Raduazo
*Attorney, Agent, or Firm*—I. Morley Drucker

[57] ABSTRACT

A centrifugal blower is disclosed wherein the impeller blades are made of a pliable, flexible, uniformly apertured sheeting made, for example, of plastic, affixed by a flexible support system, to a central rotatable shaft, so that as the rotatable shaft is driven, the apertured plastic sheet is moved centrifugally outwardly with the solid portions thereof assuming the shape of impeller blades. The impeller blades and support system therefor are made completely of thin, flexible, pliable, material, such as plastic, and the blades may assume forward curved, radial, or backward inclined configurations, during blower operation. The impeller blades cause air movement and, in turn, cause a scroll-shaped housing surrounding the impeller blades, also preferably made of plastic sheeting, to immediately inflate, directing the air to the desired location via ducts and the like, for heating, or cooling, or air conditioning or other purposes. The inflatable blower here disclosed is lighter, and more compact, when deflated, than comparably-sized steel blowers. At the same time, performance of the centrifugal blower here disclosed closely conforms to that of similarly sized steel fans in horsepower, revolutions per minute, static pressure and cubic feet per minute air delivery.

25 Claims, 11 Drawing Figures

Fig. 3
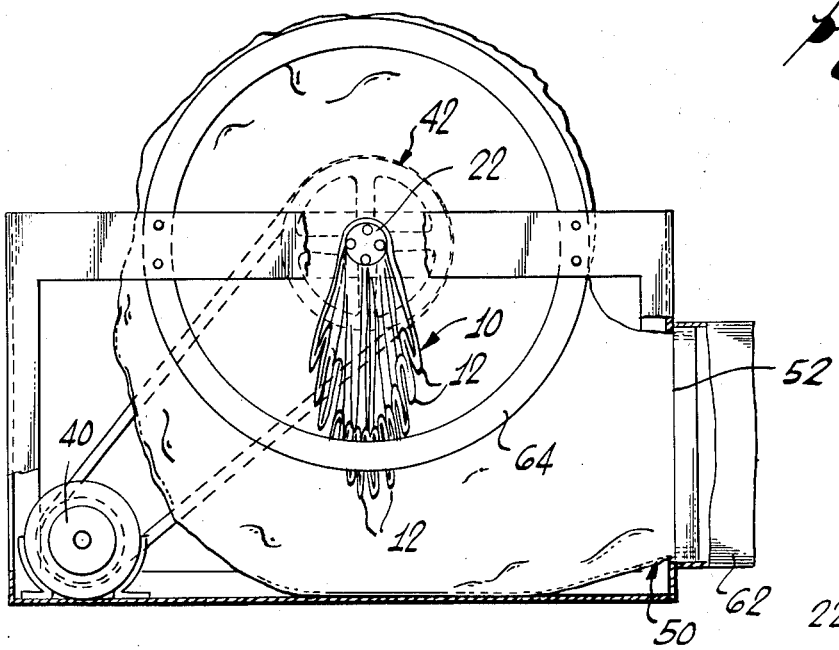
Fig. 9
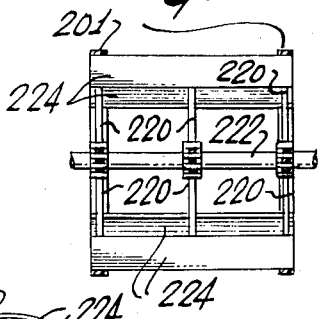
Fig. 5
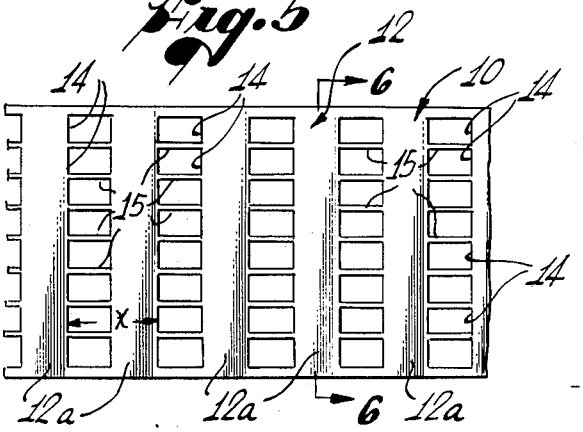
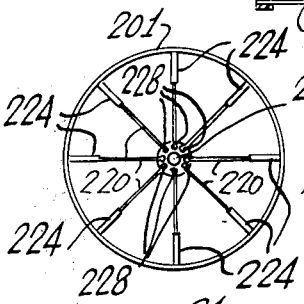
Fig. 10
Fig. 8
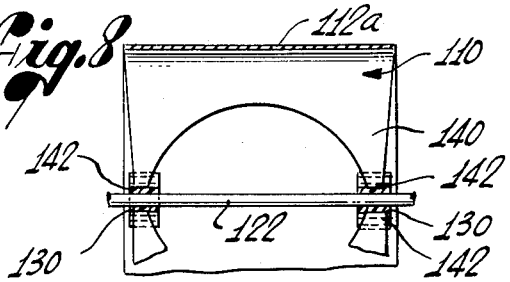
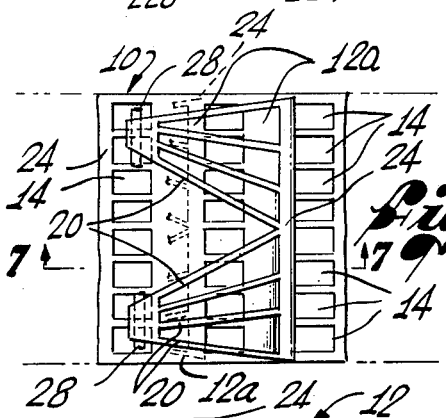
Fig. 6
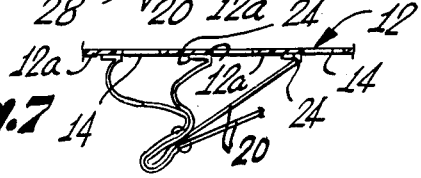
Fig. 7

INFLATABLE BLOWER

BACKGROUND OF THE INVENTION

Air blowers are generally constructed with rotatably mounted steel blades, moving within a scroll-shaped, or volute-curved metal housing. The air blowers of this type are usually expensive, bulky and heavy. Air blowers are also known in the art, which incorporate impeller blades or fan blades, made of flexible material such as molded plastic, rubber or fabric mounted to rigid frames which frames are, in turn, affixed to the rotor of the blower. See, for example, U.S. Pat. No. 2,237,451 to Smith, U.S. Pat. No. 3,306,529 to Nelson, and U.S. Pat. No. 1,868,113 to Ljungstrom. The major advantages of such prior art constructions are lightness, noncorrosiveness of the blades, and relative safety in comparison to metal-bladed fans.

However, prior art blower constructions have not, insofar as I am aware, developed a flexible impeller blade construction made essentially of low cost, light weight, plastic sheeting in combination with a thin flexible, collapsible, support system therefor, and in further combination with an inflatable scroll housing of volute-curved form (or housing of other geometric form), also made of collapsible plastic sheeting, for the purpose of rendering the blower highly compact, very light and inexpesive — in comparison to blowers having conventional metal scroll housings and conventional rigid frame support means for the impeller blades.

SUMMARY OF THE INVENTION

The centrifugal blower of this invention is directed towards the combination of the following elements:

a. a motor-driven shaft or rotor;

b. an (series of) impeller blade means made of thin, flexible, plastic or plastic-reinforced apertured sheeting; and c. A collapsible support means, preferably in the form of series of flexible, plastic or reinforced plastic cables, or strips, affixed to the motor-driven shaft, and spacedly supporting the impeller blade means away from the rotor, whereby as said shaft is rotatably driven, the cable supports for the impeller blade means are forced radially outwardly under centrifugal force, and the impeller blade means assume a specific, desired, arcuate shape thereby forcing air outwardly through a series of apertures adjacent to the blade means. The impeller blade means of the invention can be readily made to assume forward curved, radial or backward inclined configurations, during operation.

The foregoing elements (a), (b) and (c) form the "cage" or "wheel" portion of the blower, and together with a scroll housing, surrounding the cage, comprises the blower proper. The scroll housing may be made of conventional materials such as metal or rigid plastic.

In another aspect of this inveniton, however, the blower wheel elements (a), (b) and (c), just described, are combined with an inflatable scroll housing made of flexible plastic, or reinforced plastic sheet. The inflatable scroll housing surrounds the impeller blade means and immediately inflates upon rotation of the impeller blade means to direct air through the exit end of the housing.

BRIEF DESCRIPTION OF THE DRAWINGS

FIG. 3 is a fragmentary cross-sectional view, in side elevation, of the blower shown in FIG. 2, but shown in deflated condition;

FIG. 5 is a fragmentary, plan, view of the apertured impeller blades, in inflated condition, taken along the line 5—5 of FIG. 2;

FIG. 6 is a fragmentary view of one portion of the impeller blade means and cable support means therefor, in inflated condition, as seen from the interior of the blower in the direction of line 6—6 of FIG. 5;

FIG. 7 is a cross-sectional view, taken along the line 7—7 of FIG. 6, at a time when the impeller blade means is in deflated condition;

FIG. 8 is a fragmentary, axial cross-sectional view of a modified impeller blade means in inflated condition;

FIG. 9 is a fragmentary, axial side elevational view of another modified impeller blade means, in inflated condition; and FIG. 10 is an end elevational view of FIG. 9.

DETAILED DESCRIPTION OF THE PREFERRED EMBODIMENT

The inflatable blower of my invention comprises an inflatable impeller blade means, mounted for rotation to a motor-driven shaft or rotor and constitutes an inflatable blower wheel. The inflatable blower wheel is utilized with a scroll housing which may be inflatable or rigid. The blade means and scroll housing may be made entirely of thin, flexible plastic sheet or thin, flexible fiber-reinforced plastic sheet therey enabling tremendous reductions in terms of weight, size (in deflated condition) and cost, without sacrifice in air delivery and other power requirements, in comparison to conventional blowers having metal blades (or preformed plastic blade means) and rigid metal scroll housings.

Figure 2A:
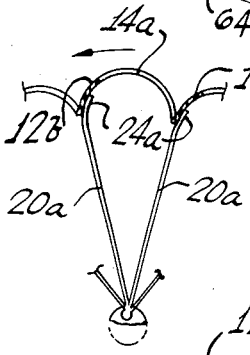
FIG. 2*a* is a fragmentary cross-sectional view, of one portion of another form of impeller blade means.
Figure 4:
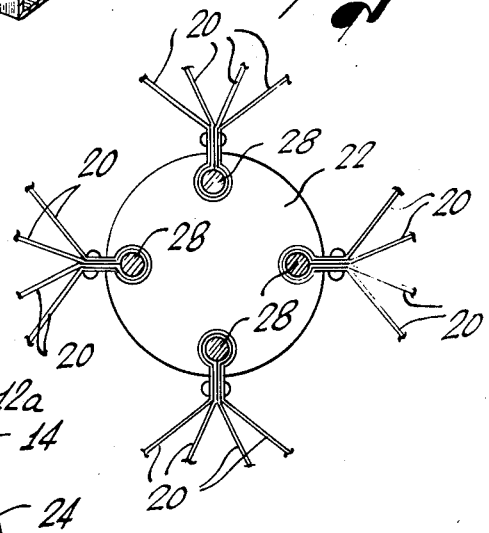
FIG. 4 is a fragmentary, enlarged, cross-sectional view, of that portion of FIG. 2, taken along the arcuate line 4 of FIG. 2.
Figure 2:
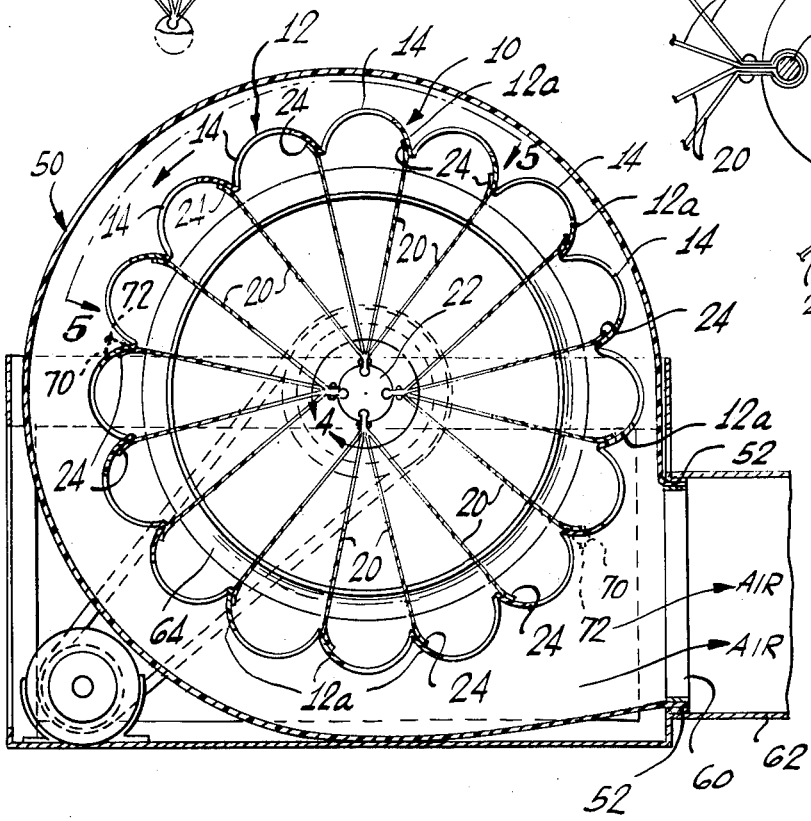
FIG. 2 is a cross-sectional view, in side elevation, taken along the line 2—2 of FIG. 1.

The inflatable impeller blade means of this invention is designated generally by the numeral 10. The impeller blade means comprises, in one preferred embodiment, a uniformly apertured, thin, flexible, collapsible, endless plastic sheet 12, as best seen in FIGS. 2 and 5, the apertures thereof being designated by the numeral 14. The apertures 14 are bounded by thin, flexible, plastic aperture strips 15, the apertures strips 15 joining adjacent blades 12*a*.

The plastic sheet 12 may be made from a unitary sheet with the apertures cut out, or may be made up from smaller sheet segments which are welded together to form the sheet. Various types of plastic sheeting materials may be employed, such as polyvinyl chloride (pvc), or nylon-reinforced pvc. Also, other types of materials may be employed such as rubber sheeting or fabric sheeting.

A flexible, collapsible, plastic cable support system, made, for example, of a pvc plastic or reinforced pvc plastic, mounts the plastic sheet 12 (the solid portions of which form a plurality of impeller blades 12*a* when the blower is operative) to a motor-driven axial shaft or rotor 22, as been seen in FIGS. 2, 4, 6 and 7. A plurality of cable support systems are provided, one for each impeller blade 12*a*. The plastic cable-support system comprises, for each impeller blade 12*a*, a plurality of diverging pvc cables or strips 20, the outer ends of which are all joined by, or mergedinto, a pvc plastic welding strip, designated 24. Each plastic welding strip 24 is preferably affixed to the interior of each impeller blade 12*a*, by heat welding in a conventional manner, e.g., by ultrasonic welding techniques.

The inner ends of each set of pvc strips 20 of the cable support systems are wrapped around, and affixed to, a metal cylinder 28, which cylinder is, in turn, stably mounted within an appropriately slotted end of rotor 22. In the particular embodiment shown, each cylinder 28 has affixed thereto the inner ends of four cable support systems. Four cylinders 28 are mounted at each end of rotor 22. Thus, it will be seen that 16 separate cable support systems are welded, at their outer ends, to 16 separate impeller blades 12*a* and are stably affixed to rotor 22. Of course, a different number of impeller blades 12*a* may be employed which will, in turn, alter the number of cable support systems required.

The support system, comprising basically cables 20 and welding strips 24, spacedly supports the impeller blade means 12 away from the rotor 22 a radial distance substantially greater than zero so that, when the rotor is driven, the cable supports are forced radially outwardly, under centrifugal force as shown in FIG. 2, and the impeller blades 12*a* become peripherally spaced from each other as best seen in FIG. 2.

While the support system just described is presently preferred, other support means for mounting impeller blades 12*a* may be provided. For example, referring to a modified support system in FIG. 8, the flexible plastic impeller blade 112*a* is affixed to a plastic support sheet 140 having end loops 142 wrapped around, and affixed within, secondary hubs. The secondary hubs 130 are, in turn, affixed to and near the ends of, the rotatable shaft 122.

The plastic impeller blades 12*a*, associated plastic cable support system and rotatable shaft 22 are surrounded by an inflatable scroll housing 50, which housing 50 is preferably made in volute curve form. The narrow end or neck 52 of the scroll housing 50 is affixed to the outlet or delivery end 60 of the blower; and the outlet end 60 is, in turn, affixed to the duct 62, or other device, to which air is to be delivered.

The sides of the scroll housing 50 are affixed to rigid or semi-rigid circular rims 64, the interior of the rims 64 being open to allow air to enter the impeller blade means 12 of the blower 10.

Figure 1:
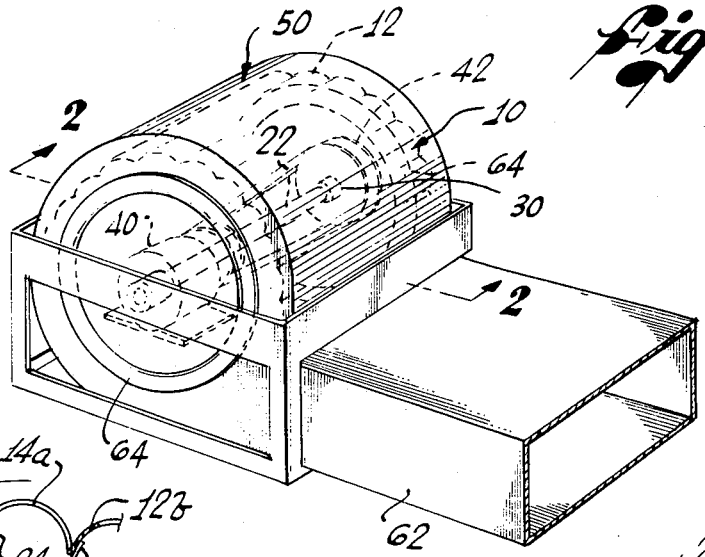
FIG. 1 is a perspective view of the centrifugal blower of this invention, in inflated condition, during operation.

Upon counter-clockwise rotation of the rotor 22, by means of electric motor 40 and associated belt drive means 42, the plastic impeller blade means 12*a*, and the plastic cable support systems therefor, move from the limp, or deflated condition shown in FIG. 3, to the inflated condition shown in FIGS. 1 and 2. The blower 10 draws air in through the openings in the sides of the scroll housing 50 (i.e., from within the open interior of the circular rims 64) to cause the inflated condition of FIGS. 1 and 2 to occur. Immediately upon the inflation of the impeller blade means, the air rushes into the scroll housing 50 (initially in a deflated condition) causing it to inflate into the volute curve shown in FIG. 2.

The peripherally spaced impeller blades 12*a* assume the forward-curved arcuate shape shown in FIG. 2, which causes the air to be efficiently moved, tangentially, past the impeller blades 12*a*, through apertures 14 immediately adjacent thereto, and into the scroll housing 50, for delivery to duct 62, or the like.

The plastic impeller blades 12*a* achieve a forward curved configuration during rotation as shown in FIG. 2, due to the relative positioning of the apertures 14, blades 12*a*, and welding strips 24. The amount of arc of each blade is varied by the overall width "X" of blade 12*a* and aperture strip 15, the shorter the width, the less arc being produced. The X dimension is shown on FIG. 5.

A different blade configuration is developed when the welding strips are affixed to the opposite side of the apertures from that of FIG. 2. Thus, referring to FIG. 2*a*, a welding strip 24*a*, of the same configuration as welding strip 24, is affixed, or welded, to an impeller blade 12*b* such that the apertures 14*a* are provided at the right of each blade 12*b*, rather than at the left. A blade configuration is developed, upon counter-clockwise rotation of the rotor, which is equivalent to a backward inclined configuration.

A radial-type blade configuration is developed as seen in FIGS. 9 and 10, when a plurality of blades 224, made of thin flexible, plastic rectangular, collapsible sheets are affixed to a rotor 222, by means of a cable support system, comprising, for example, a plurality of thin, flexible, plastic, collapsible strips 220. The outer periphery of each of the blades is held, in spaced relationship during rotation, by thin, flexible, plastic strips or bands 201, which join the outer edges of the blades 224. During rotation, the blades achieve a radial-type configuration shown in FIGS. 9 and 10.

The blower cages or wheels of this invention may be employed with a conventional scroll housing made of rigid materials, or may be made with an inflatable plastic housing. When the blower 10 is made with an inflatable scroll housing, it weights about 1/50 the weight of a comparably sized steel-bladed blower, is about 1/10 the volume in deflated condition, and much less costly to manufacture. Furthermore, there is no particular limitation in the inflated size to which the blower of this invention may be made. However, even when a rigid scroll is employed, with the inflatable wheel of this invention, significant savings, in weight, cost, and longevity of the wheel are realized.

There are some applications in which air delivery desired is such that a low rpm is required. In order to achieve an inflation of the wheel, impeller blade means may be weighted to any desired extent, for example, by means of water contained within a flexible plastic tube, which tube is, in turn, affixed to the exterior of each impeller blade. Thus, for example, a water tube 70 is shown in FIG. 2 in dotted line, welded to an impeller blade 12*a*. The tube 70 is provided with a water inlet spout 72. Other weighting or mass-producing means may be affixed to the impeller blade means of this invention.

Modifications will occur to those skilled in the art, without departing from the essence of this invention. Hence, I intend to be bound only by the claims which follow.

I claim:

1. A centrifugal wheel for a blower which comprises:

a rotor;

a impeller blade means comprising thin, flexible, collapsible sheeting forming a plurality of impeller blades and apertures adjacent thereto;

flexible, thin, collapsible, support means for said impeller blade means affixed to said rotor, said support means spacedly supporting said impeller blade means a radial distance, greater than zero, away from said rotor; and means for delivering air to said impeller blade means whereby, as said rotor is driven, said flexible, thin, collapsible support means for said impeller blade means is forced radially outwardly, under centrifugal force, and said impeller blade means thereby forces air outwardly through said apertures adjacent to said blade means.

2. The blower of claim 1 wherein said impeller blade means is made, primarily, of plastic.

3. The blower of claim 1 wherein said impeller blade means includes a plurality of flexible collapsible strips joining adjacent impeller blades and defining said apertures.

4. The blower of claim 1 wherein said flexible, thin, collapsible support means comprises a plurality of cable supports.

5. The blower of claim 1 wherein each of said impeller blades assumes a forward curve when said rotor is driven.

6. The blower of claim 1 wherein each of said impeller blades assumes a backward curve when said rotor is driven.

7. The blower of claim 1 wherein each of said impeller blades assumes a radial configuration when said rotor is driven.

8. The blower of claim 1 wherein mass producing means are affixed to said impeller blades.

9. In a blower which includes a rotor and a scroll housing having air inlet means, the improvements which comprises:

an impeller blade means comprising thin, flexible, collapsible sheeting forming a plurality of impeller blades and apertures adjacent thereto; and flexible, collapsible, support means affixed to said rotor, said support means spacedly supporting said impeller blade means a radial distance greater than zero away from said rotor whereby, as said rotor is driven and air enters said scroll housing, said support means is forced radially outwardly, under centrifugal force, and said impeller blade means thereby forces air outwardly through said apertures adjacent to said impeller blades and into said scroll housing.

10. In the blower of claim 9, the further improvement which comprises:

said scroll housing being made of thin, flexible, collapsible sheet which inflates immediately following the rotation of said impeller blade means and the outward flow of air through said apertures.

11. The blower of claim 9 wherein said impeller blade means and said support means is made, primarily, of plastic.

12. The blower of claim 9 wherein said flexible, collapsible support means comprises a plurality of cable supports.

13. In the blower of claim 9, the further improvement which includes means to define a forward curve for each of said impeller blades when said rotor is driven.

14. In the blower of claim 9, the further improvement which includes means to define a backward incline for each of said impeller blades when said rotor is driven.

15. In the blower of claim 9, the further improvement which includes means to define a radial configuration for each of said impeller blades when said rotor is driven.

16. In the blower of claim 9, the further improvement which comprises:

mass producing means affixed to said impeller blades.

17. A blower which comprises:

a rotor;

an impeller blade means comprising thin, flexible, sheeting forming a plurality of impeller blades and apertures adjacent thereto;

a collapsible support means for said sheeting affixed to said rotor;

means for delivering air to said impeller blade means whereby, as said rotor is driven, the supported impeller blade means are forced radially outwardly, under centrifugal force, and the impeller blade means thereby forces air outwardly through said apertures adjacent to the blade means; and an inflatable scroll housing surrounding said impeller blade means, which immediately inflates upon rotation of the impeller blade means and the outward flow of air through said apertures of said impeller blade means.

18. The blower of claim 17 wherein said impeller blade means is made of plastic.

19. The blower of claim 17 wherein said support means is made, primarily, of thin, flexible, collapsible, cable supports.

20. The blower of claim 17 wherein said impeller blade means includes a plurality of flexible collapsible strips joining adjacent impeller blades and defining said apertures.

21. The blower of claim 17 wherein said impeller blades are forward curved when said rotor is driven.

22. The blower of claim 17 wherein said impeller blades are radially extended when said rotor is driven.

23. The blower of claim 17 wherein said impeller blades are backward inclined when said rotor is driven.

24. The blower of claim 17 wherein mass-producing means are affixed to said impeller blade means.

25. In the blower of claim 9, the further improvement wherein said impeller blade means includes a plurality of flexible, collapsible, strips affixed to adjacent impeller blades and defining said apertures.

* * * * *